US008142150B2

(12) United States Patent
Frick et al.

(10) Patent No.: US 8,142,150 B2
(45) Date of Patent: Mar. 27, 2012

(54) ALIGNMENT DEVICE FOR GAS TURBINE CASINGS

(75) Inventors: Peyton M. Frick, Greer, SC (US); Kenneth D. Black, Travelers Rest, SC (US)

(73) Assignee: General Electric Company, Schenectady, NY (US)

( * ) Notice: Subject to any disclaimer, the term of this patent is extended or adjusted under 35 U.S.C. 154(b) by 497 days.

(21) Appl. No.: 12/399,443

(22) Filed: Mar. 6, 2009

(65) Prior Publication Data

US 2010/0226770 A1 Sep. 9, 2010

(51) Int. Cl.
*F01D 25/24* (2006.01)

(52) U.S. Cl. ..... 415/214.1

(58) Field of Classification Search ..... 415/214.1, 415/213.1, 126, 14.9, 189; 60/39, 31; 29/278, 29/272; 403/348
See application file for complete search history.

(56) References Cited

U.S. PATENT DOCUMENTS

| | | | | |
|---|---|---|---|---|
| 4,195,828 | A * | 4/1980 | Peterson | 269/43 |
| 5,094,435 | A * | 3/1992 | Depperman et al. | 269/43 |
| 5,228,181 | A * | 7/1993 | Ingle | 29/272 |
| 5,513,547 | A | 5/1996 | Lovelace | |
| 5,560,091 | A * | 10/1996 | Labit, Jr. | 29/272 |
| 6,839,979 | B1 | 1/2005 | Godbole et al. | |

* cited by examiner

*Primary Examiner* — Alexander Gilman
(74) *Attorney, Agent, or Firm* — Fletcher Yoder P.C.

(57) ABSTRACT

In one embodiment, an alignment device may be configured to align a first turbine engine casing and a second turbine engine casing. The alignment device may include a fixed portion configured to be fixedly attached to the first turbine engine casing. The alignment device may also include a bridge portion configured to interface with the second turbine engine casing, wherein the bridge portion defines a first range of motion for the fixed portion along a first axis and a second range of motion for the fixed portion along a second axis when the alignment device is engaged with the first turbine engine casing and the second turbine engine casing, and wherein the alignment device is configured to facilitate movement of the first turbine engine casing relative to the second turbine engine casing within the range of motion and the second range of motion.

19 Claims, 9 Drawing Sheets

ALIGNMENT DEVICE FOR GAS TURBINE CASINGS

BACKGROUND OF THE INVENTION

The subject matter disclosed herein relates to gas turbine engines, and more specifically, to alignment tools for moving and/or aligning sections of gas turbine engines.

In general, gas turbine engines combust a mixture of compressed air and fuel to produce hot combustion gases. The combustion gases may flow through one or more stages of turbine blades to generate power for a load and/or a compressor. The turbine engine may include several casing sections that are connected to one another in a manner that allows the enclosed turbine blades to rotate. Misalignment of the casing sections may interfere with efficient turning of the turbine blades and efficient flow of air through the engine. During assembly, these sections may be aligned by stacking the sections vertically and fastening them to one another before positioning the turbine engine assembly in a horizontal position for installation, for example by using jacks or hydraulic machinery. During service, an operator may need to access an individual section of the engine. When the section is replaced and/or reinstalled, the realignment of the section to the rest of the engine may be challenging, particularly depending on the immediate environment of the engine.

BRIEF DESCRIPTION OF THE INVENTION

In one embodiment, a system includes a first turbine engine casing section; a second turbine engine casing section; and an alignment device. The alignment device includes a fixed portion configured to be fixedly attached to the first turbine engine casing; and a bridge portion configured to interface with the second turbine engine casing section and the fixed portion, wherein the bridge portion defines a first range of motion for the fixed portion along a first axis and a second range of motion for the fixed portion along a second axis when the alignment device is engaged with the first turbine engine casing section and the second turbine engine casing section, and wherein the alignment device is configured to facilitate movement of the first turbine engine casing section relative to the second turbine engine casing section within the first range of motion and the second range of motion.

In another embodiment, an alignment device includes a fixed portion configured to be fixedly attached to the first turbine engine casing section, wherein the fixed portion comprises a rod; a bridge portion configured to interface with the fixed portion and comprising a passageway sized to accommodate the rod; and a slideable portion configured to move along an axis substantially perpendicular to the rod.

In yet another embodiment, a system includes: a first turbine engine casing adjacent to a second turbine engine casing. The system also includes a fixed portion configured to be fixedly attached to the first turbine engine casing section, wherein the fixed portion includes a rod; a bridge portion configured to interface with the fixed portion and including a passageway sized to accommodate the rod; and a slideable portion configured to move along an axis substantially perpendicular to the rod, wherein movement of the slideable portion moves the first turbine engine casing relative to the second turbine engine casing.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
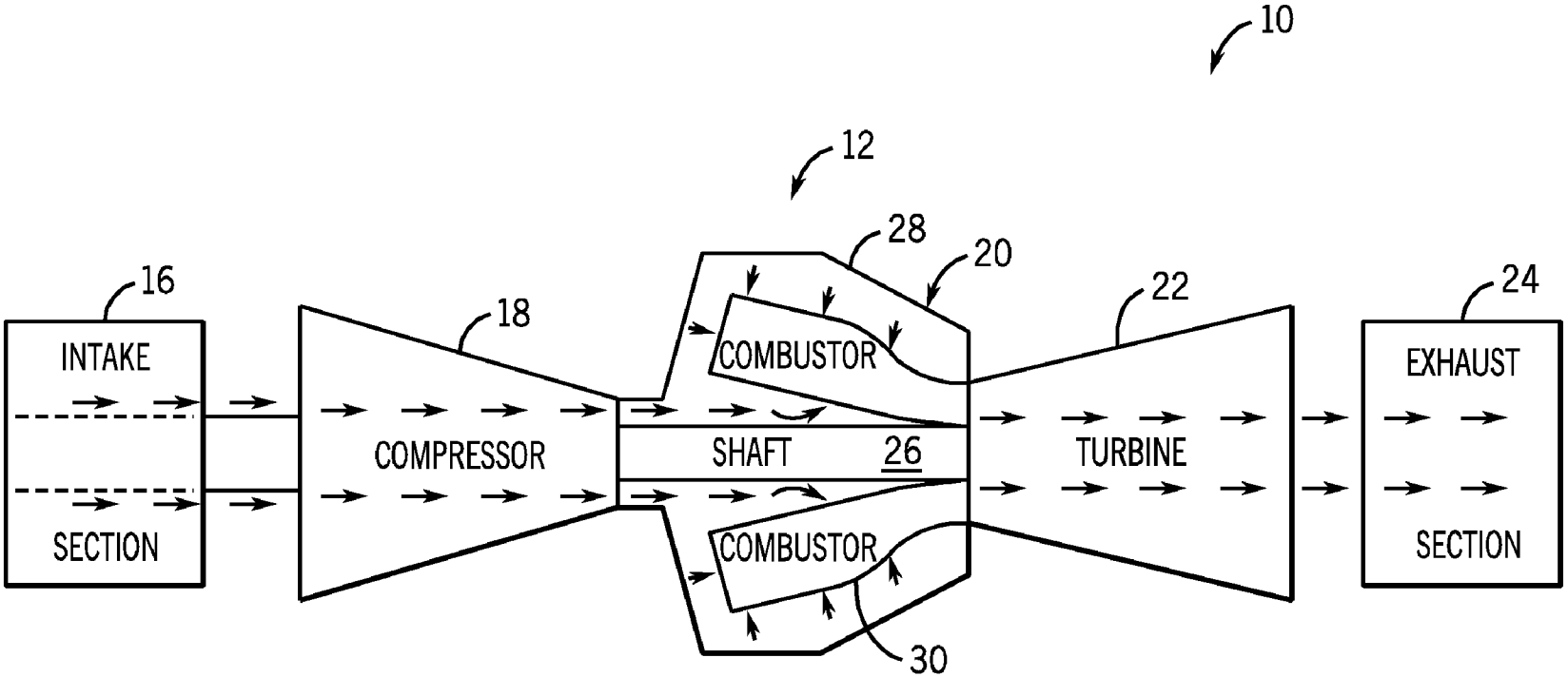
FIG. 1 is a schematic flow diagram of an embodiment of a gas turbine engine that may employ turbine blade platforms.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to alignment devices for aligning adjacent casing sections in a gas turbine engine. In the turbine part of the engine, the casing that encloses the rotating components (e.g., the shaft and blades) may be assembled in sections, which allows individual parts of the turbine to be accessed and serviced more easily. After service operations, an operator may reinstall a section of casing and perform an alignment with the adjacent sections. However, if the engine has been assembled in an area without sufficient clearance beneath the engine, hydraulic jacks or other lifts may not be suitable for holding an individual casing section and moving it into place. In addition, during normal operation of the turbine engine, these sections of casing may become slightly misaligned because, for example, the fasteners between the casings may become loose. When such misalignment occurs, the shaft and the blades may not rotate as efficiently and energy may be lost to the environment. Therefore, in accordance with certain embodiments, an alignment device may be applied to adjacent casing sections to allow an operator to perform fine alignment of the casings. The alignment device may be relatively compact in comparison to the scale of the engine, and therefore, may be applied to casing sections that are otherwise difficult to access and maneuver. The alignment device may allow more flexible installation arrangements for gas turbine engines, because alignment may be performed on casing sections that have limited surrounding clearance. Therefore, the alignment device may perform alignment of adjacent casing sections without the use of hydraulic lifts or other holding devices placed underneath the turbine engine.

The alignment device may be configured to interface with adjacent sections of casing. For example, in one embodiment, the alignment device may include a fixed portion and a bridge portion. When applied to adjacent casing sections, the fixed portion may be fixed on one casing section while not being fixed on the adjacent casing to facilitate relative movement of the adjacent casing sections. In addition, the alignment device may include a bridge or cradle portion that is not fixed on either casing section to provide additional strength and/or stability to the attachment. In an embodiment, the bridge component may define and/or limit one or more ranges of relative motion between the adjacent casing sections. After the alignment device is applied, at least a portion of the fasteners connecting the adjacent casing sections may be loosened and/or removed. The alignment device may be of sufficient strength and may have sufficient load-bearing capacity to bear the weight of the partially or completely unfastened casing sections. After the fasteners have been loosened, fine alignment may be performed by moving adjustable components of the alignment device within their ranges of motion. After the alignment is performed, the fasteners may be reapplied or tightened to lock the adjacent casing sections into place.

FIG. 1 is a block diagram of an exemplary system 10 including a gas turbine engine 12 that may include casing sections that may be aligned with the alignment tool as provided herein. In certain embodiments, the system 10 may include an aircraft, a watercraft, a locomotive, a power generation system, or combinations thereof. The illustrated gas turbine engine 12 includes an air intake section 16, a compressor 18, a combustor section 20, a turbine 22, and an exhaust section 24. The turbine 22 is drivingly coupled to the compressor 18 via a shaft 26. The shaft is also drivingly coupled to a load 14, which is positioned at the exhaust end of the turbine engine 12.

As indicated by the arrows, air may enter the gas turbine engine 12 through the intake section 16 and flow into the compressor 18, which compresses the air prior to entry into the combustor section 20. The illustrated combustor section 20 includes a combustor housing 28 disposed concentrically or annularly about the shaft 26 between the compressor 18 and the turbine 22. The compressed air from the compressor 18 enters combustors 30 where the compressed air may mix and combust with fuel within the combustors 30 to drive the turbine 22.

From the combustor section 20, the hot combustion gases flow through the turbine 22, driving the compressor 18 via the shaft 26. For example, the combustion gases may apply motive forces to turbine rotor blades within the turbine 22 to rotate the shaft 26. After flowing through the turbine 22, the hot combustion gases may exit the gas turbine engine 12 through the exhaust section 24.

Figure 2:
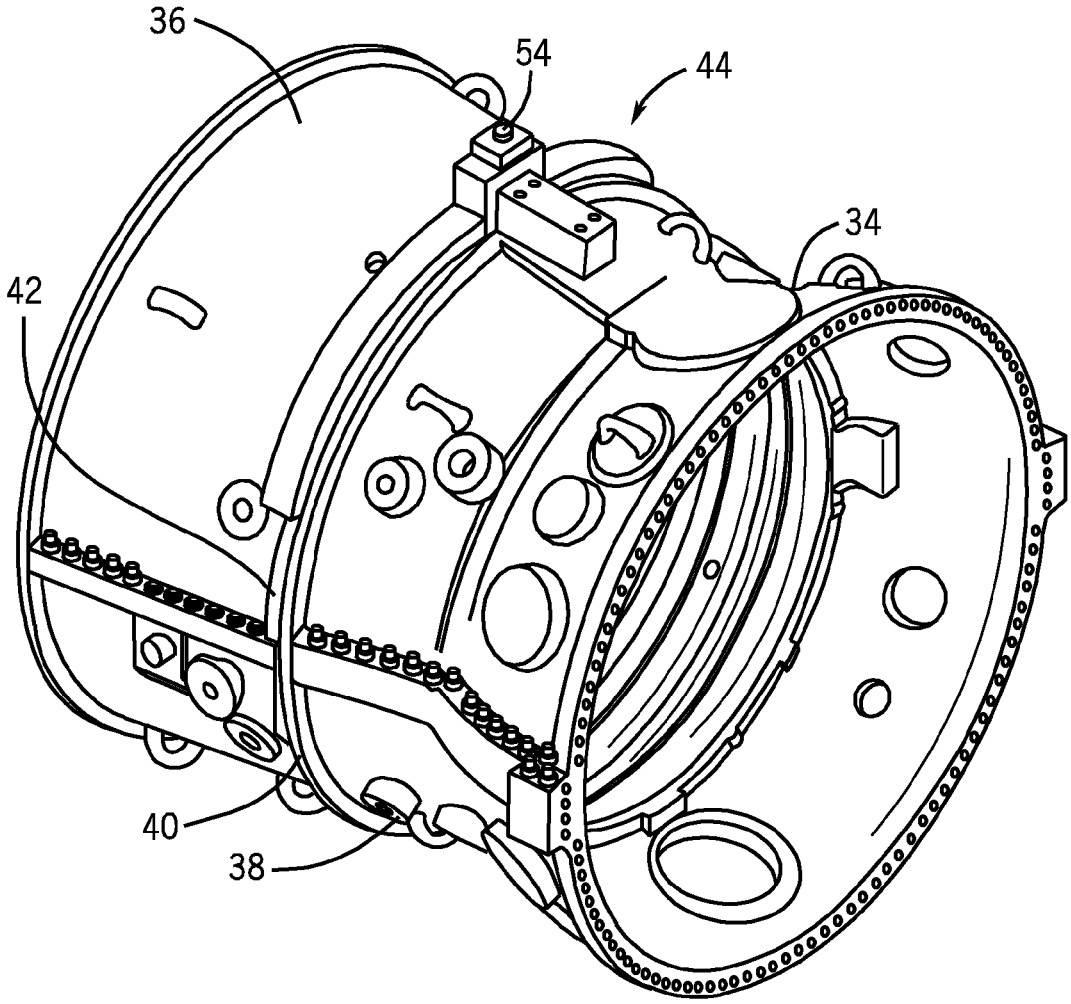
FIG. 2 is a perspective view of an embodiment of adjacent exterior casings of a gas turbine engine with an alignment device applied to the adjacent casings.

FIG. 2 is a side view of an embodiment of a portion of gas turbine engine 12 of FIG. 1 of the engine 12. As depicted, a first engine casing section 34 and a second engine casing section 36 are adjacent to one another. Typically, a casing section may be attached to adjacent sections by a plurality of bolts 38 around the circumference of the casings, shown here as connecting flanges 40 and 42 on casing section 34 and casing section 36, respectively. As shown, an alignment device 44, discussed in more detail below, may be applied to the two adjacent casings 34 and 36. Generally, the movement may be facilitated by moveable portions of the alignment device 44 that move within limited ranges of motion along certain axes. For example, the movement may be facilitated by moving a rod 54 along its axis. Because the alignment device 44 is fixed to one casing section, e.g., casing section 34, but not to the adjacent section, e.g., casing section 36, movement of the rod 54 results in casing section 34 being moved along the axis of the rod. The movement of the rod 54 is within a limited range of motion that is dictated by the structure of the alignment device 44.

Figure 3:
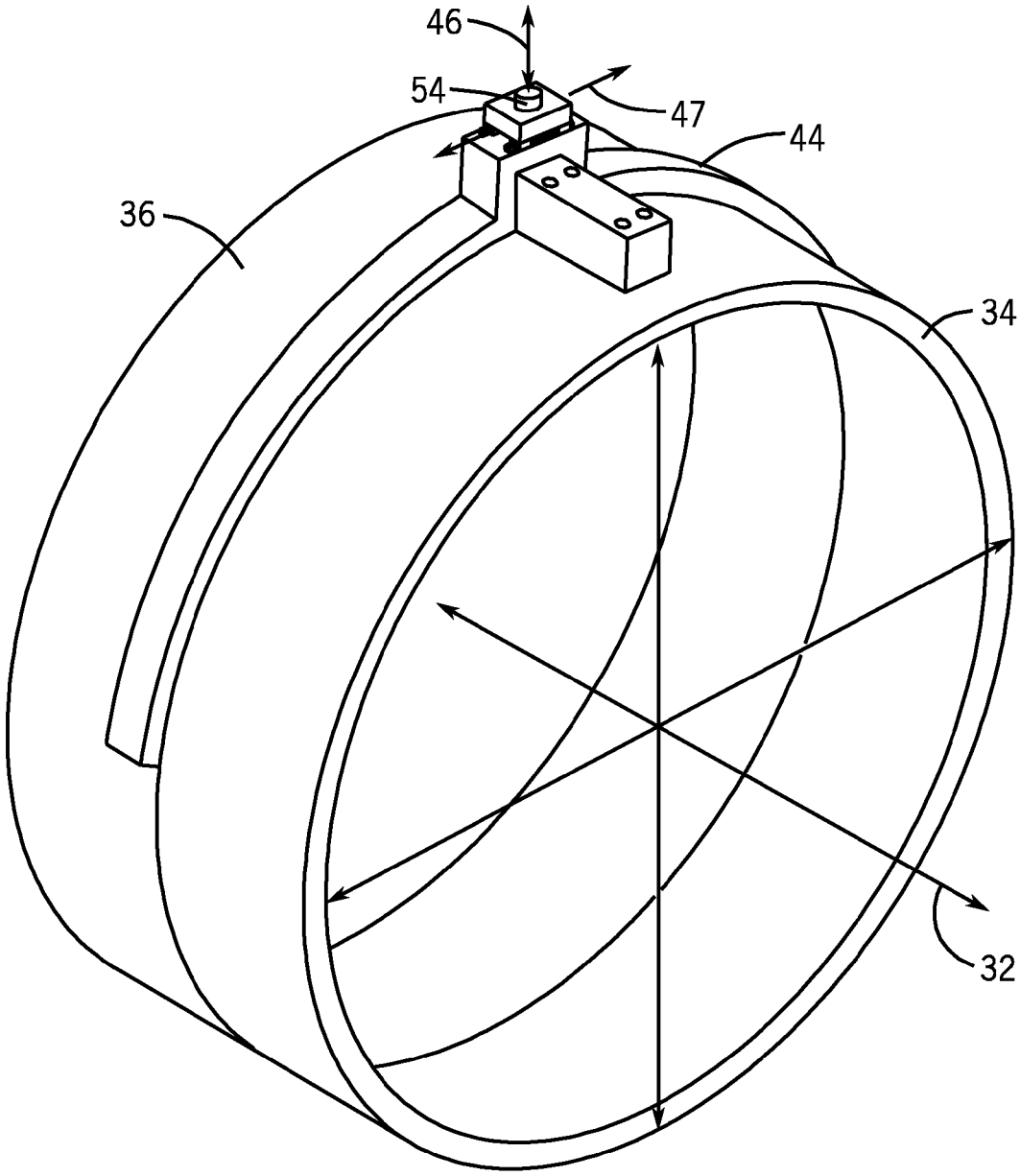
FIG. 3 is perspective view of an embodiment of adjacent exterior casings of a gas turbine engine with an alignment device applied to the adjacent casings and the axes of motion of the alignment device.

More specifically, when the alignment device 44 is mounted on the adjacent casing sections 34 and 36, the first casing section 34 may move relative to casing section 36 along axis 46, the axis substantially in-line with the rod 54, and axis 47, which is substantially perpendicular to the rod 54, as shown in FIG. 3. In should be understood that axes 46 and 47 are defined by the placement of the alignment device on the casing sections 34 and 36. As shown, axis 46 may be a generally vertical axis while axis 47 may be a generally horizontal axis, whereby both axes are generally perpendicular to the flow path of flow path axis 32 and are perpendicular to each other. In embodiments, axis 47 may be a circumferential axis, and may therefore have a slight curvature that follows the circumference of a generic turbine engine casing section. In addition, as shown, the alignment device may allow movement in both directions along axes 46 and 47. For example, in an embodiment in which the alignment device 44 is placed generally on a top or upper portion of an alignment device, axis 46 is generally vertical. In such an embodiment, the movement of the rod 54 may pull the casing section 34 up while casing section 36 remains substantially in place. The rod 54 could also be pushed down to move casing section 34 down relative to casing section 36. The movement of rod 54 in either direction along axis 47 may move casing section 34 in a circumferential direction relative to casing section 36.

Figure 4:
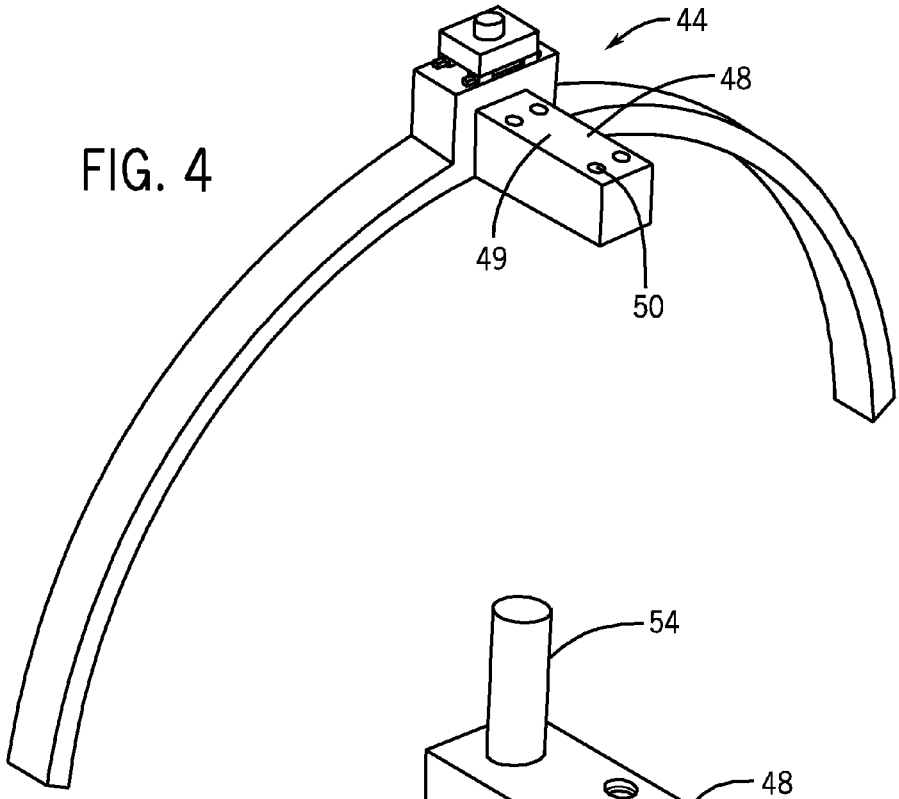
FIG. 4 is perspective view of an embodiment of an alignment device

An exemplary alignment device 44 is shown in perspective view in FIG. 4. The alignment device 44 may be formed from any suitable materials, including cast metals. The alignment device 44 may include a fixed portion 48 configured to be fastened or otherwise mounted to casing section 34. As shown in FIG. 4, the fixed portion 48 may include passageways 50 sized and shaped to receive a series of bolts or other fasteners, such that the bolt heads may be atop an exterior face 49 of the fixed portion. In embodiments, a generic turbine engine casing section (e.g., casing section 34) may include predrilled passageways configured to be fastened to the fixed portion 48 at an appropriate location.

Figure 5:
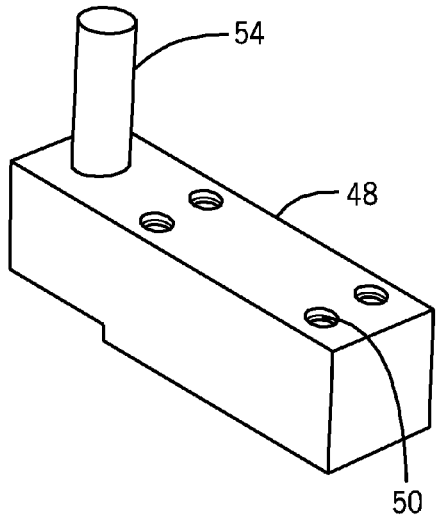
FIG. 5 is a perspective view of an embodiment of a fixed portion component of the alignment device shown in FIG. 4.

As shown in more detail in the perspective view of FIG. 5, the fixed portion 48 may include a rod 54 that is either integrally formed with the fixed portion 48 or is otherwise attached or connected to the fixed portion 48. In embodiments in which the rod 54 is not unitary with the fixed portion 48, the fixed portion 48 may include a passageway configured to receive the rod 54, such as a threaded passageway that rod 54 may be screwed into. When the fixed portion 48 is fastened to casing section 34, the rod 54 may facilitate movement of casing section 34 along axis 46 to align casing section 34 relative to casing section 36.

Figure 6:
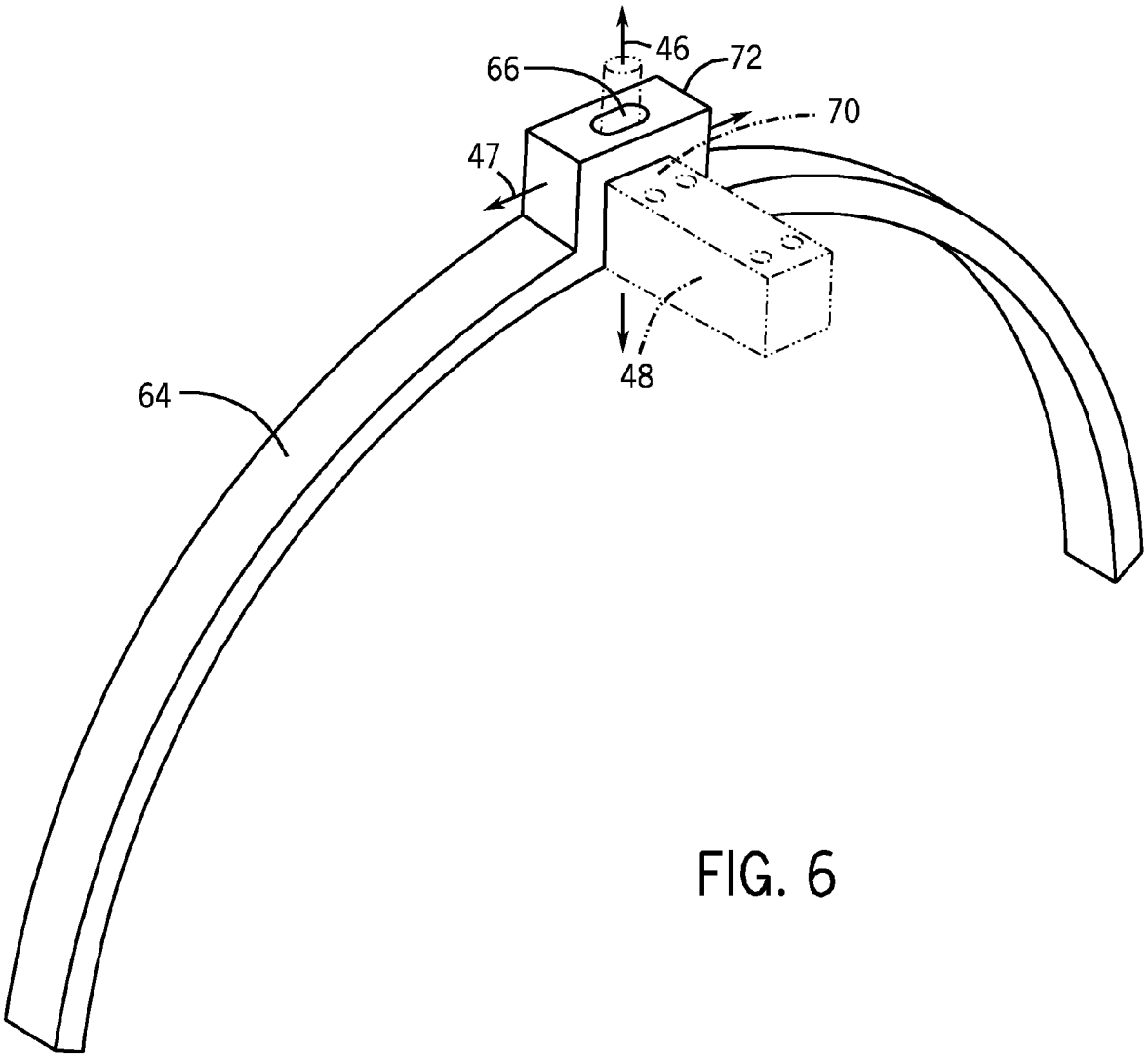
FIG. 6 is a perspective view of an embodiment of a bridge portion component of the alignment device shown in FIG. 4.

The alignment device 44 may also include a bridge portion 64, shown in FIG. 6. Bridge portion 64 may be sized and shaped to fit over fixed portion 48 and to rest on casing section 36. The bridge portion 64 may include a passageway 66 sized to be larger than rod 54. The amount that the passageway 66 exceeds the diameter of rod 54 may dictate the range of motion of casing section 34 relative to casing section 36 along axis 47. In addition, when bridge portion 64 rests atop fixed portion 48, the assembly may include a gap or step 70 between a table 72 and exterior face 49 of the fixed portion 48. The size of step 70 may dictate the range of vertical motion along axis 46 of casing section 34 relative to casing section 36. In embodiments, bridge portion 64 may interface with a portion of casing section 36. In embodiments, the bridge portion 64 may at least partially encircle a portion of casing section 36. For example, in embodiments the bridge portion 64 may contact at least about a 30° portion of the circumference of casing section 36, at least about a 45° portion of the circumference of casing section 36, at least about a 90° degree portion of the circumference of casing section 36, or at least about a 120° degree portion of the circumference of casing section 36.

Figure 7:
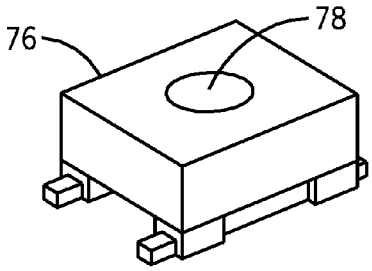
FIG. 7 is a perspective view of an embodiment of a slideable portion component of the alignment device shown in FIG. 4.
Figure 8:
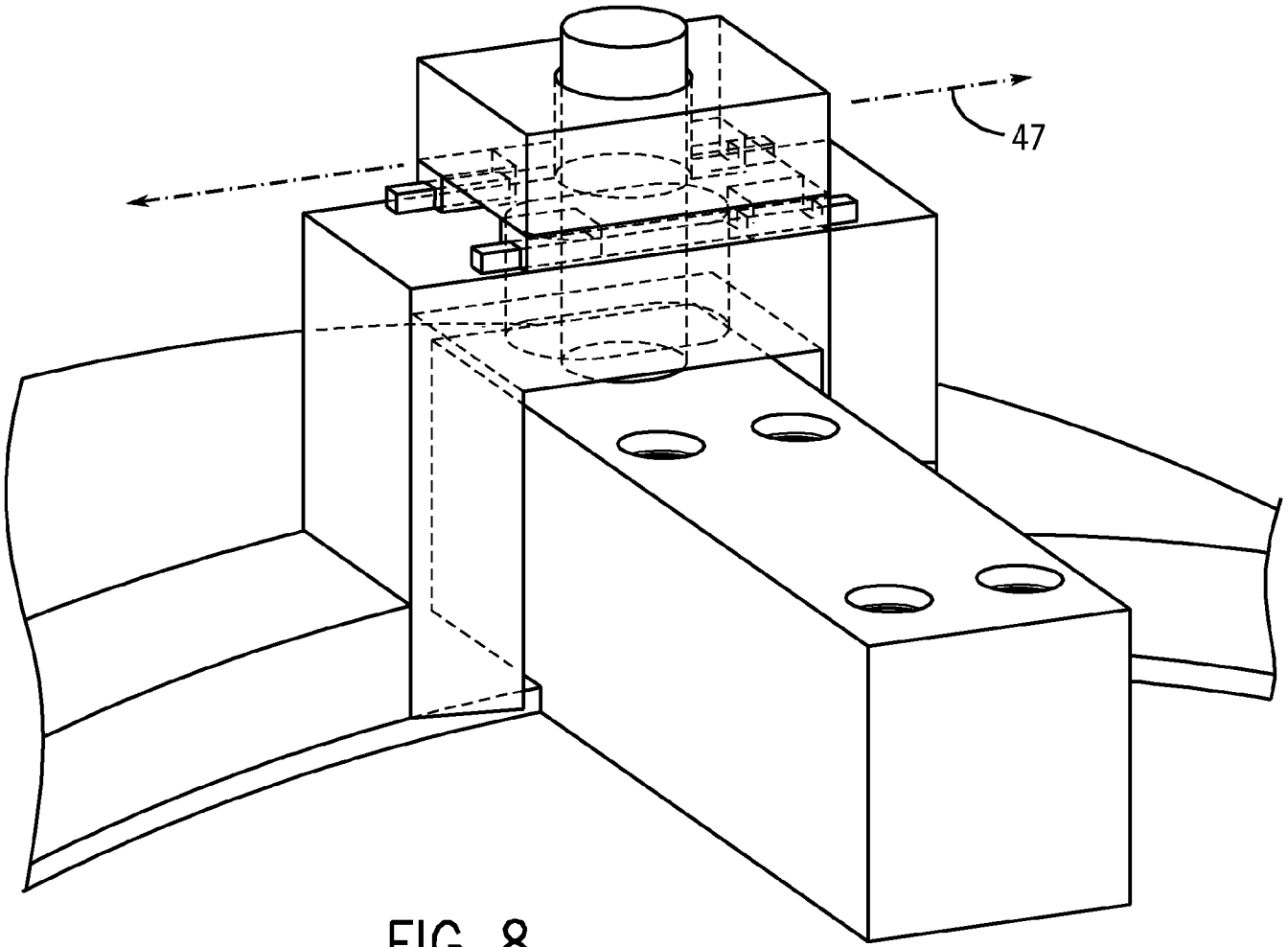
FIG. 8 is a perspective view of an embodiment of a slideable motion of a rod structure of an alignment device.

In embodiments, alignment device 44 may also include a slideable portion 76, shown in perspective view in FIG. 7. The slideable portion 76 may be sized and shaped to rest atop table 72 of bridge portion 64 and may be configured to move along axis 47. In one embodiment, slideable portion 76 may be attached to bridge portion 64. In another embodiment, slideable portion 76 may be a separable component from bridge portion 64. Slideable portion 76 may include a passageway 78 sized to accommodate rod 54. The diameter of passageway 78 may be relatively smaller than the diameter of passageway 66. As shown in the perspective view of FIG. 8, rod 54 moves along axis 47 when slideable portion 76 slides relative to table 72. As a result, when rod 54 moves along axis 47, casing section 34, to which fixed portion 48 is attached, also moves relative to casing section 36.

Figure 9:
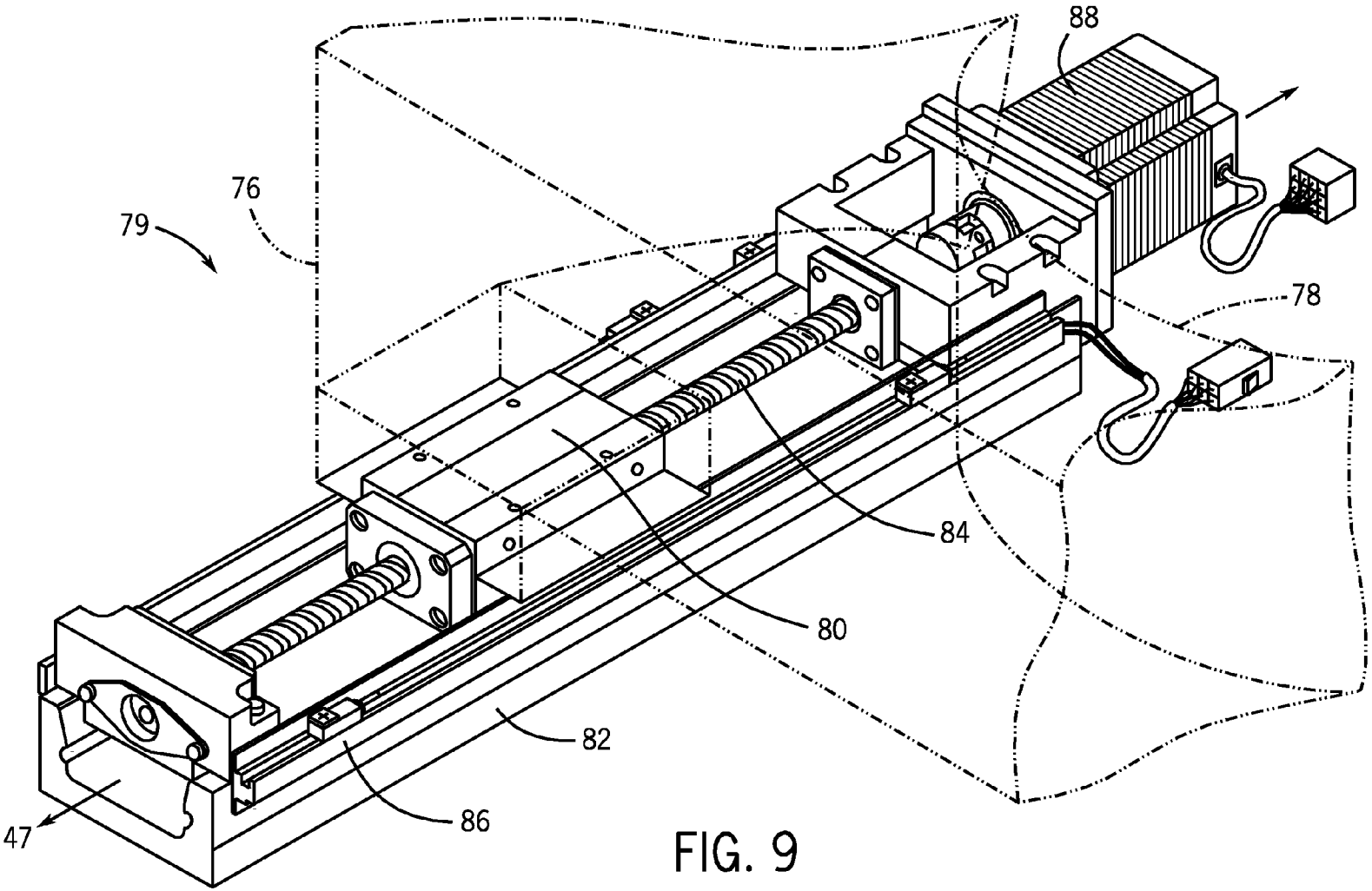
FIG. 9 is a cutaway perspective view of an embodiment of a slide table of an exemplary slideable portion.

In one embodiment, the movement of slideable portion 76 along axis 47 may be facilitated by a motorized assembly 79. As shown in FIG. 9, slideable portion 76 may include a slide table 80 that moves along track rail 82 via ball screw 84. The motorized assembly 79 may include one or more sensor rails 86 to facilitate control of the rate and position of the movement. The motor 88 may provide the power to the assembly 79. In embodiments, the motorized assembly 79 may be under the control of a processor-based device.

Figure 10:
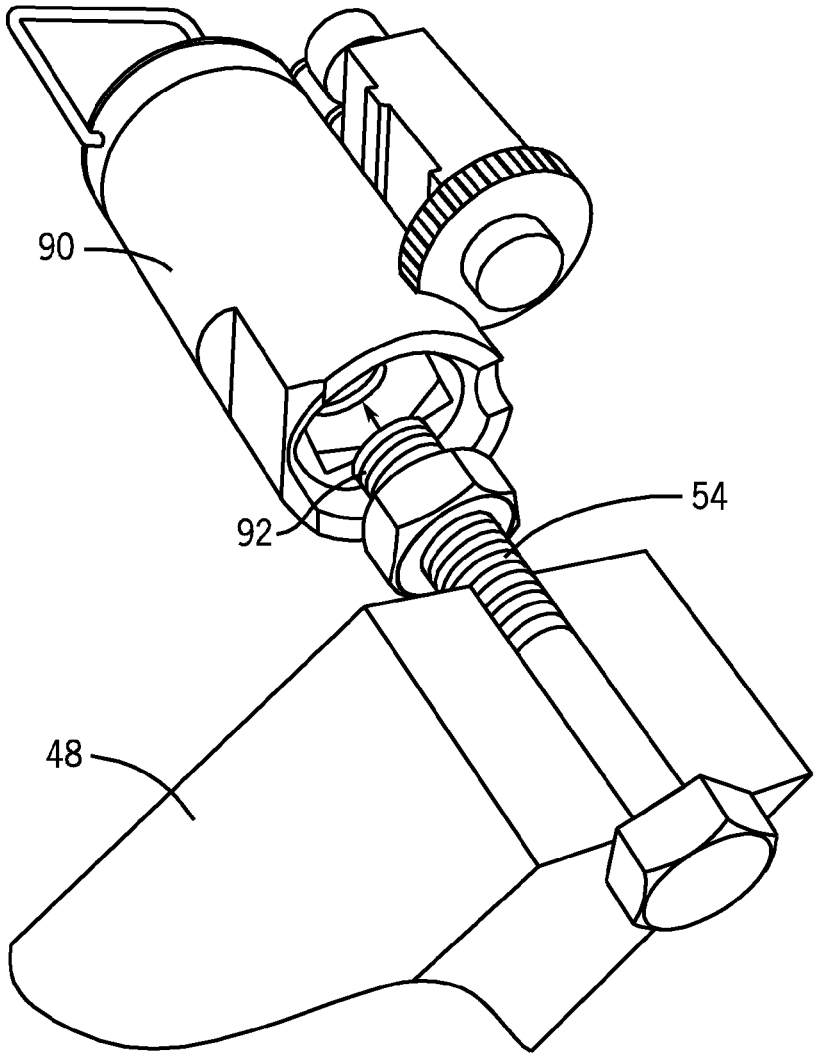
FIG. 10 is a perspective view of an embodiment of a bolt elongation device affixed to a rod portion to facilitate vertical movement.

In another embodiment, the movement of the rod 54 may be facilitated by a hydraulic tensioner or bolt elongation device 90. As shown in FIG. 10, the rod 54 may interface with bolt elongation device 90 to pull fixed portion 48 along axis 46. As shown, the rod 54 may include a threaded end 92. In other embodiments, the rod 54 may include a hook, passageway, or other connection point for the bolt elongation device 90. It should be noted that the rod 54 does not extend below fixed portion 48 to engage the second casing section 36.

Figure 11:
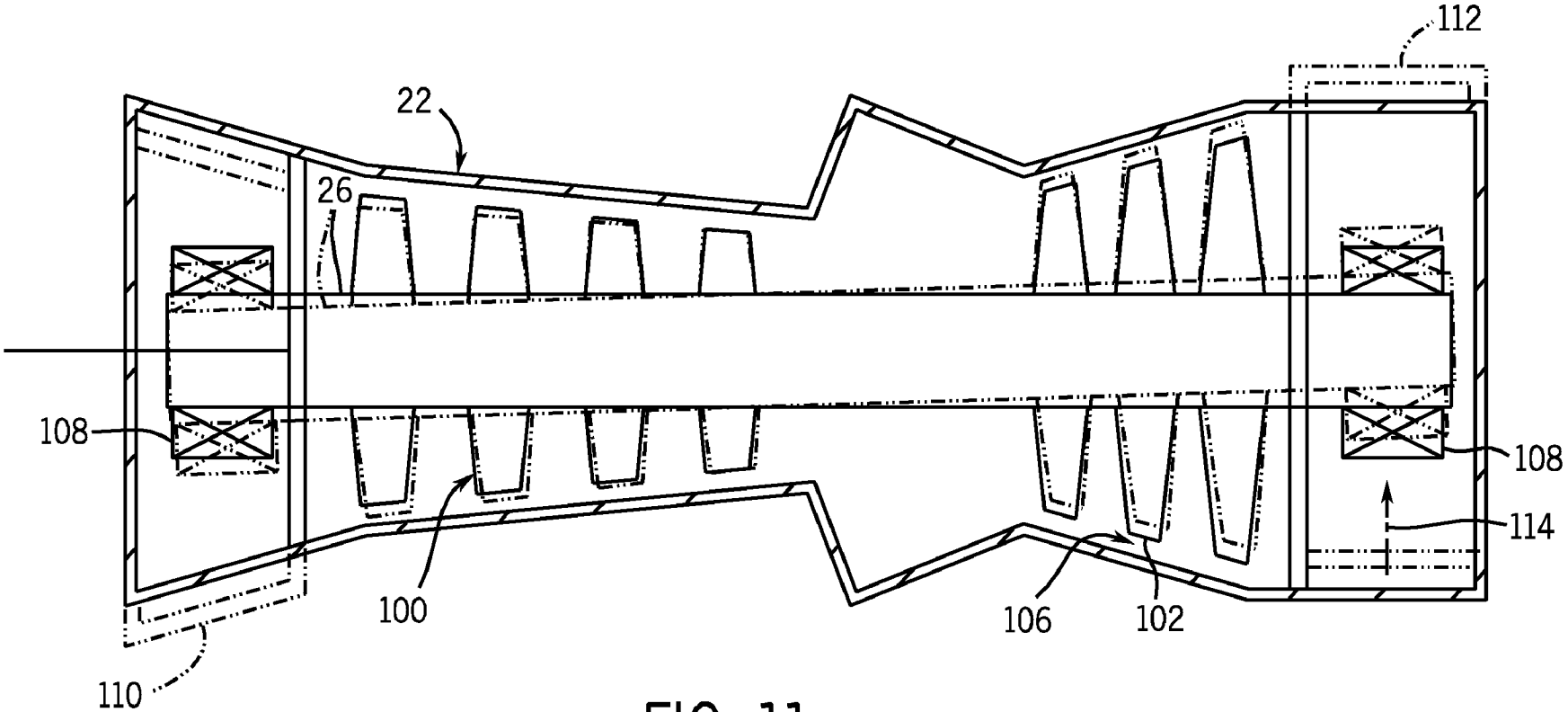
FIG. 11 is a cutaway side view of an embodiment of a turbine in which turbine blade clearance is aligned relative to the turbine casing.

In one embodiment, alignment of adjacent casing sections may allow an operator to optimize the clearance of the turbine blade tip relative to the casing. FIG. 11 is a partial cutaway side view of an exemplary turbine 22. The rotating shaft 26 sits on two bearings 108. Blades 100 are distributed about the shaft 26 and rotate in the turbine 22. Air that moves past blade tips 102 into the clearance space 106 between a turbine casing (e.g. casing section 36) and the blade tip 102 may decrease the efficiency of the turbine 22. Accordingly, the clearance 106 may be changed by alignment performed on an inlet casing section 110 or an outlet casing section 112. As shown in FIG. 11, casing section 112 may be moved in a direction 114 relative to the inlet casing section 110. These casing sections 110 and 112 include bearings 108 on which the shaft 26 sits. Accordingly, in one embodiment, alignment of casing section 110 or 112 may move one or both of the bearings 108 as well. This impacts the alignment of the shaft 26 throughout the turbine 22, which can in turn change the position of the blades 100 and blade tips 102. In other embodiments, such alignment may be also performed on the compressor section 18, which may include blades that rotate about the shaft 26.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a first turbine engine casing section;

a second turbine engine casing section; and an alignment device comprising:

a fixed portion configured to be fixedly attached to the first turbine engine casing; and a bridge portion configured to interface with the second turbine engine casing section and the fixed portion, wherein the bridge portion defines a first range of motion for the fixed portion along a first axis and a second range of motion for the fixed portion along a second axis when the alignment device is engaged with the first turbine engine casing section and the second turbine engine casing section, and wherein the alignment device is configured to facilitate movement of the first turbine engine casing section relative to the second turbine engine casing section within the first range of motion, wherein the first axis is non-parallel to the second axis and the second range of motion.

2. The system of claim 1, wherein the fixed portion comprises one or more passageways configured to receive one or more fasteners.

3. The system of claim 1, wherein the first turbine engine casing section comprises one or more passageways that correspond to the passageways of the fixed portion and are configured to receive the one or more fasteners.

4. The system of claim 1, wherein the bridge portion is configured to contact at least about a forty-five degree portion of an exterior circumference of the second turbine engine casing section.

5. The system of claim 1, wherein the bridge portion comprises a passageway configured to define the first range of motion.

6. The system of claim 1, wherein the alignment device comprises a gap between the bridge portion and the fixed portion configured to define the second range of motion.

7. The system of claim 1, wherein the first range of motion is circumferential motion of the first turbine engine casing section relative to the second turbine engine casing section.

8. The system of claim 1, comprising a rotor or rotary blades housed within the first turbine engine casing or the second turbine engine casing.

9. An alignment device configured to align a first turbine engine casing section with a second turbine engine casing section, the alignment device comprising:

a fixed portion configured to be fixedly attached to the first turbine engine casing section, wherein the fixed portion comprises a rod;

a bridge portion configured to interface with the fixed portion and comprising a passageway sized to accommodate the rod; and a slideable portion configured to move along an axis substantially perpendicular to the rod, such that movement of the slideable portion results in a change in circumferential position of the first turbine engine casing section relative to the second turbine engine casing section.

10. The alignment device of claim 9, comprising a hydraulic device coupled to the rod and configured to pull the rod along an axis substantially in-line with the rod.

11. The alignment device of claim 9, wherein the rod comprises a threaded end.

12. The alignment device of claim 9, wherein the rod is integrally formed with the fixed portion.

13. The alignment device of claim 9, wherein slideable portion is coupled to a driver configured to move along the axis substantially perpendicular to the rod.

14. The alignment device of claim 9, comprising a turbine engine having at least the first turbine engine casing section and the second turbine engine casing section.

15. The alignment device of claim 14, wherein the first turbine engine casing section is configured to move relative to the second turbine engine casing section when the slideable portion moves along the axis.

16. The alignment device of claim 14, wherein the rod is configured to move along an axis substantially in-line with the rod, whereby the movement of the rod changes the position the first turbine engine casing section relative to the second turbine engine.

17. A system comprising:

a first turbine engine casing adjacent to a second turbine engine casing;

a fixed portion configured to be fixedly attached to the first turbine engine casing section, wherein the fixed portion comprises a rod;

a bridge portion configured to interface with the fixed portion and comprising a passageway sized to accommodate the rod; and a slideable portion configured to move along an axis substantially perpendicular to the rod, wherein movement of the slideable portion moves the first turbine engine casing relative to the second turbine engine casing, and wherein the rod is configured to move along an axis substantially in-line with the rod, whereby the movement of the rod changes the position the first turbine engine casing section relative to the second turbine engine.

18. The system of claim 17, wherein the first turbine engine casing section comprises one or more passageways that correspond to the passageways of the fixed portion and are configured to receive the one or more fasteners.

19. The system of claim 17, wherein the bridge portion is configured to contact at least about a forty-five degree portion of an exterior circumference of the second turbine engine casing section.

* * * * *